United States Patent [19]

White

[11] 4,010,027

[45] Mar. 1, 1977

[54] PROCESSES FOR STEEL MAKING BY OXYGEN REFINING OF IRON

[75] Inventor: James White, Ranby Retford, England

[73] Assignee: Lafarge Fondu International, Neuilly sur Seine, France

[22] Filed: May 15, 1975

[21] Appl. No.: 577,840

[30] Foreign Application Priority Data

May 15, 1974 France ..... 74.16937

[52] U.S. Cl. ..... 75/52; 75/94

[51] Int. Cl.[2] ..... C21C 7/02; C22B 9/10

[58] Field of Search ..... 75/94, 52–60

[56] References Cited

UNITED STATES PATENTS

| | | | |
|---|---|---|---|
| 3,318,687 | 5/1967 | Bowden | 75/53 |
| 3,537,842 | 11/1970 | Holland | 75/53 |
| 3,585,025 | 6/1971 | Obst | 75/53 |
| 3,802,865 | 4/1974 | Ohkubo | 75/53 |

*Primary Examiner*—Peter D. Rosenberg

*Attorney, Agent, or Firm*—Oblon, Fisher, Spivak, McClelland & Maier

[57] ABSTRACT

The present invention relates to a process for obtaining low phosphorus steel by oxygen refining of liquid iron in the presence of a slag containing lime, alumina, silica and iron oxides wherein at the beginning of the operation is added to the liquid metal a charge obtained by granulation and calcination of a mixture of an hydraulic aluminous cement with lime and magnesia in order to obtain at the end of the operation a slag containing

| | |
|---|---|
| CaO | 40 to 60 % |
| $SiO_2$ | 5 to 25 % |
| MgO | 2.5 to 15 % |
| $Al_2O_3$ | 5 to 25 % |
| Iron oxides expressed as $Fe_2O_3$ | 10 to 35 % |
| $P_2O_5$ | 0.5 to 10 % |

9 Claims, No Drawings

PROCESSES FOR STEEL MAKING BY OXYGEN REFINING OF IRON

The process for obtaining steel by oxygen refining of iron known under the names of LD, LD-AC, Kaldo, OLP etc . . . which have made their appearance since a quarter of a century have seen their economic importance grow rapidly.

In these processes pure oxygen is blown with the aid of a lance into a bath of liquid iron so as to oxidize and eliminate the impurities in the metal. It has been known for a long time that a certain quantity of CaO can be added to the iron in order to form a slag.

It is useful to provide first of all an explanation of the use of the word slag which, often employed in different ways, can be a source of confusion. To the empty converter is added line (CaO) plus a melting flux ($CaF_2$, bauxite . . . ) and then liquid iron. The mixture (CaO + flux), combines with the impurities in the iron to form a slag. The mixture (CaO + flux) is not itself a slag but enables a slag to be formed. Nevertheless, certain authors refer to the mixture (Cao + flux) as a slag, (for example in the two patents referred to later in the description of the present invention) whereas this is referred to in France, as a charge. This charge is called slag or self-forming slag by certain English writers. When refining of the iron is completed, the slag which floats on the surface, is poured from the converter, and is then referred to in the present text as slag.

One of the most important roles of CaO is to facilitate the elimination of phosphorus by formation of calcium phosphate soluble in the slag. It is therefore important that the slag should be saturated with lime with the highest concentration possible.

Unfortunately, it is observed that the lime solid at the temperature of the operation, approximately 1650° C, has a tendency to form compounds such as $3CaO.SiO_2$ or $2CaO.SiO_2$ which are also solid and which isolate each particle of lime in such a way that the liquid slag is not saturated with lime and hence has a reduced effectiveness for the removal of phosphorus.

This effect can be reduced by increasing the amount of lime but this plays the role of an inert charge which reduces the yield of the operation, alternatively, finely divided lime can be used but this involves other difficulties (milling, hygrometry of the quick lime, dust problems . . . ) or increasing the oxygen blowing time which is undesirable since it reduces the rate of use of the converter and increases the specific oxygen consumption or alternatively adding melting fluxes such as calcium borates (colemanite) or fluorspar, but these products are expensive and undesirable — fluorspar particularly because of the deterioration of the refractory lining of the converter which it engenders and the risk of atmospheric pollution from its fluorine content.

It has been proposed as a replacement for fluorine or borate compounds to use $Al_2O_3$ and iron oxides. The reason is that these oxides act as a flux for the lime at the fabrication temperature of the steel (approximately 1650° C) and thus facilitate the solution of lime in the slag and also increase the quantity of lime which can be dissolved in the slag before reaching saturation.

It is important to explain clearly that the concentration ratios implied above are relative to the molten slag at the end of the refining operation, since it is when approaching this stage that the activity of the slag for removing impurities must be at its highest. Nevertheless, charges prepared in advance as in patents FR 2 005 176 and 2 077 587 can give rise to slags for which the final compositions can be widely different. These differences of composition are due both to variations in the initial metal composition and the ratio $$\frac{\text{final weight of slag}}{\text{final weight of metal}}.$$

Nevertheless, with normal slag compositions, these additions do not prevent the formation mentioned above of solid calcium silicates at the lime-slag interface. This inconvenience can be avoided by the addition of large quantities of $Al_2O_3$ and $Fe_2O_3$ but this solution is not desirable since it involves a large increase in the slag mass.

The explanation of these phenomena can be found in the examination of published phase diagrams of the systems CaO — $Al_2O_3$ — $SiO_2$ and CaO — (iron oxides) — $SiO_2$. In these systems up to high values of the ratios $Al_2O_3/SiO_2$ and (iron oxides)/$SiO_2$ the slag, when it dissolves CaO at the fabrication temperature of the steel becomes saturated not with CaO but with $3CaO.SiO_2$ or $2CaO.SiO_2$ both solid, the silicate formed depending on the value of the ratios previously mentioned. To avoid this effect, it is necessary that the ratios by weight of $Al_2O_3/SiO_2$ and (iron oxides)/$SiO_2$ are greater that 70/30 and 79/21 respectively. Under these conditions, the saturated slags are in equilibrium with CaO and the solid silicates mentioned do not appear. When the ratios $Al_2O_3/SiO_2$ equal 70/30 and (iron oxides)/$SiO_2$ equal 79/21, the lime contents of slags saturated at 1650° C are respectively 64% and 55% by weight, that is to say that the slag weights are respectively about 9.8 and 9.5 times the weights of silica that they contain and that the ratio (weight of slags)/(weight of silica) increases as the ratios $Al_2O_3/SiO_2$ and (iron oxides)/$SiO_2$ increase.

In studying phase relations in the system CaO — MgO — $Al_2O_3$ — (iron oxides) — $SiO_2$ one finds surprisingly when the ratio by weight $MgO/R_2O_3$ ($R_2O_3$ signifying here the sum $Al_2O_3$ + iron oxides) is less than 0.65 approximately, the maximum value of the ratio by weight $R_2O_3/SiO_2$ for which the slag is in equilibrium with solid CaO at 1650° C can be increased from a minimum value of 0.8 approximately and that the total weight of slag becoming only six times the weight of silica, can be reduced.

The same argument can be used for the more complete diagrams CaO — $Al_2O_3$ — MgO — iron oxides — $P_2O_5$ — MnO despite the complexity of these diagrams. In effect one can see that if the ratio by weight $MgO/R_2O_3$ is lower than 0.65 ($R_2O_3$ indicating here the sum $Al_2O_3$ plus iron oxides), the maximum value of the ratio by weight $R_2O_3/(SiO_2 + P_2O_5)$ for which the slag is in equilibrium with solid CaO at 1650° C can be increased from a minimum value of 0.8 and that the ratio weight of slag/weight of iron to be refined can be reduced. This is illustrated in example 1, numbers B(1), B(2), B(3), B(4).

The use of slags having these values of the ratio $MgO/R_2O_3$ offers the advantage that when the slags are saturated with CaO they are near saturation in MgO and consequently have relatively little corrosive action on the refractory linings of dolomite and magnesite normally used in these processes.

The present invention enables a liquid slag to be obtained which fulfills the conditions indicated above.

The rapidity of melting of the slags having the characteristics defined in the present invention offers the advantage of obtaining quickly a more homogeneous slag. Consequently, the period during which refining is hindered by the presence of solid calcium silicates is diminished due to an increase in reaction rates. The effect is to speed up the refining operation, to reduce oxygen consumption and wear on the refractories (since the time of contact between molten materials and the refractory linings is reduced).

The present invention also enables the addition of fluorine compounds used in the basic process in which phosphorus is removed during the refining operations to be reduced or eliminated.

An advantage of the slags in the present invention is that, given their chemical composition and notably the presence of MgO — $Al_2O_3$ — oxides of iron, the activity of the iron oxides in the liquid slag is very high from the beginning of the refining operation. This minimises the passage into solution in the slag of iron oxides from metal oxidation and thus improves the process yield of steel. See example 1, numbers B 3 and B 4.

A further advantage of the present invention is that the slag being always saturated with respect both to CaO and MgO it is much less corrosive than the slags currently employed to the magnesia or dolomitic refractory linings normally used in LD converters.

Additionally the reduction in or elimination of the use of fluorspar in the charge reduces the cost of the process, reduces difficulties associated with the increasing rarety of fluorspar and avoids atmospheric pollution due to the emission of fluorine compounds during the blow.

The process according to the invention consists of adding to the metal at the beginning of the operation, a charge with a composition calculated such that at the end of the operation a slag is obtained containing:

| | |
|---|---|
| CaO | 40 to 60 % |
| $SiO_2$ | 5 to 25 % |
| MgO | 2.5 to 15 % |
| $Al_2O_3$ | 5 to 25 % |
| Iron oxides expressed as $Fe_2O_3$ | 10 to 35 % |
| $P_2O_5$ | 0.5 to 10 % |

with:

$MgO/R_2O_3$ less than 0.65

$R_2O_3/(SiO_2 + P_2O_5)$ greater than 0.8

$MgO/SiO_2$ between 0.3 and 0.7

$Al_2O_3/Fe_2O_3$ between 0.10 and 3 preferably between 0.15 and 2.5.

Six components slags having the compositions shown above, have now to date been studied in oxygen steel making processes and the studies of the inventor have shown surprisingly that during their formation, the system maintains a very satisfactory meltability and fluidity and has specific effectiveness for obtaining low phosphorus steels.

Preferably, the slags are obtained by introducing to the bath of liquid iron in the converter and during the refining process, a charge obtained by mixing, granulation, sintering or fusion after milling, natural or artificial products.

Amongst the natural products are included:

bauxites which provide $Al_2O_3$, $Fe_2O_3$ limestones which provide $CaCO_3$ dolomites which provide $MgCO_3$, $CaCO_3$ giobertite which provides $MgCO_3$ hematite ores which provide $Fe_2O_3$ Amongst the artificial products should be mentioned as particularly advantageous aluminous cements such as ciment fondu to which it is suggested to add appropriate quantities of CaO and MgO which can also be obtained from industrial processes to obtain the desired compositions.

The compositions of the charge must be calculated to give a slag of final composition defined above. They depend obviously on the impurity content (Si, P, Mn, S, C, . . .) of the iron to be refined and on the ratio weight of slag/weight of iron to be refined which must be as low as possible.

The impurity contents of irons vary widely and depend essentially on the quality of the iron ore and the method of manufacture. Considering the usual concentrations of Si, P, Mn, C . . . in irons as normally manufactured, such as:

| | | | | |
|---|---|---|---|---|
| C | between | 4 | and | 5 % |
| Si | between | 0.3 | and | 1.5 % |
| P | between | 0.05 | and | 0.3 % |
| Mn | between | 0.1 | and | 0.9 % |
| etc. | | | | |

and assuming a ratio weight of slag/weight of iron to be refined between 0.1 and 0.2 (the total weight of iron to be refined being: weight of liquid iron plus weight of scrap iron plus weight of rolling mill waste, etc . . .), it is possible to determine the composition of the charge required in the case of the 2 irons defined above. This gives:

| | | | | | |
|---|---|---|---|---|---|
| CaO | between | 40 | and | 85 % | |
| $Al_2O_3$ | between | 10 | and | 27 % | |
| $SiO_2$ | between | 0,5 | and | 5 % | |
| Iron oxides | between | 0,5 | and | 25 % | (expressed as $Fe_2O_3$ |
| MgO | between | 5 | and | 17 % | |

For each iron composition to be refined and for each ratio weight of slag/total weight of iron to be refined, it is easy to calculate the composition of the charge to give the final slag composition previously defined.

The slag obtained by virtue of its lime content has properties which make it hydraulic. It can be used alone or in mixtures with other known hydraulic materials, such as portland cements or aluminous cements or calcium sulphates. In view of its magnesia content, it is particularly suitable for road applications and similar work.

Among the examples which follow experiments have been carried out comparing the process as defined in the present invention with those currently practiced. Various methods of using the invention have then been detailed.

EXAMPLE 1

Starting with an iron of composition

| | | | |
|---|---|---|---|
| C, | 4.53 % | Mn, | 0.26 % |
| P, | 0.08 % | S, | 0.023 % |
| Si, | 1.14 % | | |

to be refined by the LD process one uses, either current slag compositions or slags as defined in the present invention.

A. Refining with current slag compositions 200 tonnes of iron of the above composition are placed in the converter at 1350° C. After the commencement of oxygen blowing, 15.7 tonnes of lime plus dolomite, 1.5 tonnes of fluorspar and 0.5 tonnes of bauxite are added and one obtains at the end of the refining operation 30 tonnes of a slag of composition:

| | | |
|---|---|---|
| $SiO_2$, | 16.3 % | |
| $P_2O_5$, | 1.22 % | |
| oxides of iron, | 30 % | (expressed as $Fe_2O_3$) |
| CaO, | 47.28 % | |
| MgO, | 4.5 % | |
| $Al_2O_3$, | 0.7 % | |

and 190 tons of iron composition:

| | |
|---|---|
| C, | 0.055 % |
| P, | 0.014 % |
| Mn, | 0.190 % |
| S, | 0.017 % |

and:

weight of slag/weight of iron to be refined, 0.15
weight of steel/weight of iron to be refined, 0.95

B. Refining with slag compositions as in the present invention

1. To 200 tonnes of iron to be refined of the composition already defined, are added 15.4 tonnes of a mixture having the composition expressed as oxides:

| | | |
|---|---|---|
| CaO, | 71 % | |
| $Al_2O_3$, | 18 % | |
| MgO, | 9 % | |
| $SiO_2$, | 0.5 % | |
| Iron oxides, | 1.5 % | (expressed as $Fe_2O_3$) |

from which is obtained at the end of the refining operation 26 tonnes of slag having the composition:

| | | |
|---|---|---|
| $SiO_2$, | 18.8 % | |
| $P_2O_5$, | 1.4 % | |
| Iron oxides, | 20.0 % | (expressed as $Fe_2O_3$) |
| $Al_2O_3$, | 11.0 % | |
| CaO, | 42.7 % | |
| MgO, | 6.1 % | |

and 190 tonnes of steel of composition:

| | |
|---|---|
| C, | 0.055 % |
| S, | 0.017 % |
| P, | 0.014 % |
| Mn, | 0.190 % |

and:

weight of slag/weight of iron to be refined, 0.13
weight of steel/weight of iron to be refined, 0.95 representing a gain of 15% in the former of the two ratios above compared with current slag compositions for the same yield of steel.

2. To 200 tonnes of iron of the composition already defined to be refined are added 12.94 tonnes of a mixture of composition expressed as oxides:

| | | |
|---|---|---|
| CaO, | 75.4 % | |
| $Al_2O_3$, | 11.0 % | |
| $SiO_2$, | 0.6 % | |
| Iron oxides, | 1.0 % | (expressed as $Fe_2O_3$) |
| MgO, | 12.0 % | |

from which is obtained at the end of the refining operation 26 tonnes of slag of composition:

| | | |
|---|---|---|
| $SiO_2$, | 18.8 % | |
| $P_2O_5$, | 1.4 % | |
| Iron oxides, | 28.0 % | (expressed as $Fe_2O_3$) |
| $Al_2O_3$, | 5.0 % | |
| CaO | 40.3 % | |
| MgO, | 6.5 % | |

and 190 tonnes of steel of the same composition as in example A. One finds that for the same ratios weight of slag/weight of iron to be refined, 0.13
weight of steel/weight of iron to be refined, 0.95 that the ratio weight of charge added/weight of iron to be refined is reduced by 16% compared with example B (1), and is reduced by 27% compared with example A.

3. To 200 tonnes of iron to be refined of the composition already defined is added 16.8 tonnes of a mixture of composition expressed as oxides:

| | | |
|---|---|---|
| CaO, | 59.0 % | |
| MgO, | 8.0 % | |
| $Al_2O_3$, | 10.5 % | |
| Iron oxides, | 22.0 % | (expressed as $Fe_2O_3$) |
| $SiO_2$, | 0.5 % | |

and one obtains at the end of the refining operation 26 tonnes of slag of composition:

| | | |
|---|---|---|
| $SiO_2$, | 18.0 % | |
| $P_2O_5$, | 1.4 % | |
| Iron oxides, | 28.0 % | (expressed as $Fe_2O_3$) |
| $Al_2O_3$, | 6.5 % | |
| CaO, | 40.1 % | |
| MgO, | 6.0 % | |

and 193 tonnes of steel of composition:

| | |
|---|---|
| C, | 0.05 % |
| S, | 0.017 % |
| P, | 0.013 % |
| Mn, | 0.21 % |

The yield of steel is improved by 1.5% compared with current practice.

4. To 200 tonnes of iron to be refined of the composition already defined are added 18 tonnes of a mixture of composition expressed as oxides:

| | | |
|---|---|---|
| CaO, | 65 % | |
| MgO, | 10 % | |
| $Al_2O_3$, | 17 % | |
| Iron oxides, | 7 % | (expressed as $Fe_2O_3$) |

-continued

| | |
|---|---|
| $SiO_2$, | 1 % |

One obtains at the end of the refining operation 26 tonnes of slag of composition:

| | | |
|---|---|---|
| $SiO_2$, | 18.8 % | |
| $P_2O_5$, | 1.4 % | |
| Iron oxides, | 15.0 % | (expressed as $Fe_2O_3$) |
| CaO, | 45.5 % | |
| MgO, | 7.3 % | |
| $Al_2O_3$, | 12.0 % | |

and 192 tonnes of steel of composition identical to that of example B (3). The yield of steel has thus been improved by 1% compared to current practice.

EXAMPLE 2

A mixture M1 is prepared by milling: 37.4 tonnes of bauxite containing by weight.

50% $Al_2O_3$, 25% $Fe_2O_3$, 3.5% $SiO_2$, 1.5% $TiO_2$, 0.5% CaO, 30 tonnes of dolomite containing 51% $CaCO_3$, 44% $MgCO_3$ 115 tonnes of limestone containing 85% $CaCO_3$.

After milling, the mixture is sintered at 1200° C approximately and then reduced to a granulometry averaging 20 mm with elimination of particles smaller than 8 mm. The composition is: 63.5% Cao; 18.7% $Al_2O_3$; 1.4% $SiO_2$; 9.52% $Fe_2O_3$; 6.3% MgO; 0.6% $TiO_2$.

104 tonnes of liquid iron of composition 4.0% C; 0.5% Si; 0.6% Mn; 0.4% P; 0.05% S, is added to the LD converter.

41 tonnes of scrap iron and after 3 minutes 7 tonnes of the mixture M1 defined above is added.

After 5 minutes oxygen blowing is commenced which continues for 20 minutes during which 3.5 tonnes of the mixture M1 are progressively added. At the end of the operation a steel is obtained containing: 0.055% C; 0.05% Si; 0.012% Mn; 0.014% P; 0.017% S and 15 tonnes of slag of composition: 45.3% CaO; 14.3% $Al_2O_3$; 10.8% $SiO_2$; 15.1% $Fe_2O_3$; 5.0% MgO; 7.6% MnO; 3.2% $P_2O_5$.

EXAMPLE 3

A mixture M2 is prepared in the same manner as the mixture M1 described in the previous example having a composition of 56% CaO; 27.0% $Al_2O_3$; 11.0% $Fe_2O_3$; 6% MgO.

110 tonnes of liquid iron of composition 4.0% C; 1.0% Si; 0.6% Mn; 0.1% P; 0.05% S are placed in the LD converter plus 40 tonnes of scrap iron and then after 3 minutes is added 9 tonnes of a mixture M2. After 5 minutes oxygen blowing is commenced which continues for 30 minutes during which 5 tonnes of mixture M2 is progressively added.

At the end of the operation 140 tonnes of steel are obtained containing:

C: < 0.055%, Si: 0.05%, P: 0.006%,

Mn: < 0.01%, S:< 0.02% and 18 tonnes of slag of composition:

CaO: 43.3%, $Al_2O_3$: 23.0% $Fe_2O_3$: 11.1% $SiO_2$: 8.4%, MgO: 4.2%.

EXAMPLE 4

A mixture M3 is prepared by milling:

100 tonnes of a ciment fondu containing by weight CaO: 38%, $Al_2O_3$: 38.5%, $Fe_2O_3$: 11%, FeO: 4.0%, MgO: 1.0%, $SiO_2$: 3.1% $SO_3$: less than 1%. Metal Fe: traces.

40 tonnes of dolomite containing 51% $CaCO_3$ and 44% $MgCO_3$

78tonnes of limestone containing 85% $CaCO_3$ after milling the mixture is sintered at 1250° C approximately and then reduced to a granulometry averaging 20 mm, the particles smaller than 8 mm being eliminated. The composition is:

CaO: 56.8%

$Al_2O_3$: 25.2%

$Fe_2O_3$: 9.8%

MgO: 6.1%

$SiO_2$: 2% plus various impurities ($TiO_2$ etc . . .)

110 tonnes of liquid iron of composition: C: 4.0%, Si: 1.0%, Mn: 0.6%, P: 0.1%, S: 0.05% are placed in the LD converter and 30 tonnes of scrap iron. Then after 3 minutes 10 tonnes of the mixture M3 are added. After 5 minutes oxygen blowing is commenced which continues for 30 minutes with progressive addition of 5 tonnes of the mixture M3.

At the end of the operation 145 tonnes of steel are obtained containing: C: < 0.05%, Si: traces, P: < 0.01%, Mn: < 0.01%, S: < 0.02%, and 13 tonnes of slag of composition: CaO: 42%, $Al_2O_3$: 22%, $Fe_2O_3$: 12%, $SiO_2$: 9%, MgO: 6%.

I claim:

1. A process for obtaining low phosphorus steel by oxygen refining of liquid iron in the presence of a slag containing lime, alumina, silica and iron oxides characterized in that at the beginning of the operation is added to the liquid metal a charge of a composition calculated such that during all the refining operation the slag contains a solid phase consisting substantially only of calcium oxide, which disappears at the end of operation and only at this moment, and a liquid phase which remains substantially saturated in magnesium oxide and such that at the end of the operation a slag is obtained containing:

| | |
|---|---|
| CaO | 40 to 60 % |
| $SiO_2$ | 5 to 25 % |
| MgO | 2.5 to 15 % |
| $Al_2O_3$ | 5 to 25 % |
| Iron oxides expressed as $Fe_2O_3$ | 10 to 35 % |
| $P_2O_5$ | 0.5 to 10 % |

with $MgO/R_2O_3$ less than .65

$R_2O_3/SiO_2 + P_2O_5$ greater than 0.8

$MgO/SiO_2$ between 0.3 and 0.7

$Al_2O_3/Fe_2O_3$ between 0.10 and 3.0, wherein $R_2O_3$ is the sum of $Al_2O_3$ and iron oxides in said slag.

2. The process of claim 1 characterised in that the slag obtained at the end of the operation has a ratio $Al_2O_3/Fe_2O_3$ between 0.15 and 2.5.

3. The process of claim 1 characterised in that the charge is obtained by milling, sintering and re-milling of a mixture to a defined granulometry.

4. The process of claim 1 in which the charge is obtained by at least partial fusion of the mixture and milling to a defined granulometry.

5. The process of claim 1 characterised in that the charge is obtained by granulation and light calcination of a mixture of a hydraulic aluminous cement with convenient quantities of lime and magnesia.

6. The process of claim 3 characterised in that the charge has a granulometry between 4 and 40 mm approximately.

7. The process of claim 1 wherein simultaneously a low phosphorus steel and a hydraulic binder is obtained.

8. The process of claim 1, wherein the slag is evacuated only at the end of the operation.

9. The process of claim 1, wherein said low phosphorus steel contains between 0.014% and 0.006% phosphorus.

* * * * *